United States Patent [19]

Itaya et al.

[11] Patent Number: 4,525,056

[45] Date of Patent: Jun. 25, 1985

[54] DEVELOPING MEANS FOR ELECTROSTATIC LATENT IMAGE

[75] Inventors: Masahiko Itaya; Satoshi Haneda; Makoto Tomono, all of Hachioji, Japan

[73] Assignee: Konishiroku Photo Industry Co., Ltd., Tokyo, Japan

[21] Appl. No.: 386,630

[22] Filed: Jun. 9, 1982

[30] Foreign Application Priority Data

Jul. 10, 1981 [JP] Japan ..... 56-108445

[51] Int. Cl.[3] ..... G03G 15/09

[52] U.S. Cl. ..... 355/3 DD; 355/14 D; 118/657; 118/658

[58] Field of Search ..... 355/3 DD, 14 D, 3 R, 355/14 R; 118/657, 658; 430/120

[56] References Cited

U.S. PATENT DOCUMENTS 4,030,447 6/1977 Takahashi et al. ..... 355/3 DD X 4,168,901 9/1979 Ito et al. ..... 355/3 DD

*Primary Examiner*—A. C. Prescott

*Attorney, Agent, or Firm*—Jordan B. Bierman

[57] ABSTRACT

A developing means for an electrostatic latent image has, within a non-magnetic developer transport member, plural magnets arranged in series in a defined area between a develops layer thickness regulating member and a developing area opposite an image forming member so as to generate a magnetic flux distribution having a pair of homopolar peaks for eliminating a density uneveness of the developer layer on said transport member.

7 Claims, 4 Drawing Figures

DEVELOPING MEANS FOR ELECTROSTATIC LATENT IMAGE

BACKGROUND OF THE INVENTION

1. Field of the Invention

The present invention relates to a developing means for an electrostatic latent image, and particularly to the developing means for an electrostatic latent image improved in the elimination of uneven density caused in the developing process for a magnetic developer.

2. Description of the Prior Art

In developing means for an electrostatic latent image, a developer layer of the developer is formed on a developer transport member such as a cylindrical developing sleeve, and the thickness of said developer layer is regulated by a developer layer thickness regulating member such as a doctor blade. In the case of a one component magnetic developer, it is necessary to regulate in the order of 0.2 mm in a developer layer thickness regulating member. The one component magnetic developer is apt to be coagulated with together when a high temperature, high humidity, pressure or the like is applied thereto to become the coagulated developer.

There have frequently occurred the troubles of developer transport because said coagulated developer hitch on around the space between a cylindrical developing sleeve and a doctor blade, so that an evenness have frequently caused lengthwise over an image. This kind of trouble has not been solved yet even in a copying machine for which a one component magnetic developer being practically used.

SUMMARY OF THE INVENTION

It is an object of the present invention to provide with a developing means for an electrostatic latent image which the above-mentioned faults are improved. Above object of the present invention can be accomplished by a developing means for an electrostatic latent image comprising a non-magnetic developer transport member, a magnet fixed inside said non-magnetic transport member, and a developer layer thickness regulating member, which a plurality of said megnets generating respectively a magnetic flux distribution having a homopolar peak are arranged in series adjacent to the places between a developer layer thickness regulating member and a development area on the non-magnetic developer transport member opposite to an image forming member.

In the Japanese Patent Application Open to Public Inspection No. 95243/1979, there has been proposed that homopolar magnets are arranged one after another in a development area in order to eliminate the evenness of density. According to the experiments of our inventors, however, it was less effective to arrange them in a developing area, and it was found the fact that it was much effective to arrange them between the development area and a developer layer thickness regulating member provided before said development area.

DETAILED DESCRIPTION OF THE PREFERRED EMBODIMENTS

Figure 1:
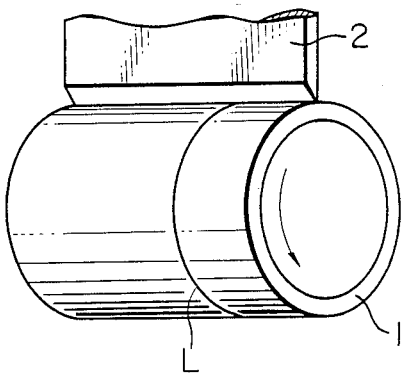
FIG. 1 shows an illustrative view of a producing mechanism of a white streak.

The following is the detailed description of the present invention with reference to the drawings as an embodiment of a one component magnetic developer. FIG. 1 shows an illustrative view showing how a white streak is caused. Wherein, the space between the circumferential surface of a developing sleeve 1 as a developer transport member, and a doctor blade 2 as developer layer thickness regulating member is uniformly maintained at the distance of the order of 0.2 mm to 0.5 mm. Said space is quite narrower than that in the case of using a two-component developer. On the other hand, a one-component developer is apt to be coagulated and be much the more in the case of high temperature and humidity. If coagulation of developers happen, a coagulated developer hitch in the space between the developing sleeve 1 and the doctor blade 2 and supplying of the developer is stopped at the hitched place to cause a white streak. If a development was made as the toner was on the circumferential surface of the developing sleeve 1 in such a state as described above, a density unevenness causes therefrom on an image.

With the purpose of eliminating such a trouble, there have been proposed the developing means in which a member for cleaning the doctor blade 2 is provided, and methods in which coagulation of a developer is prevented from occurring or in which coagulated developer is destroyed, however there cannot be found any definite measure to eliminate them.

Figure 2:
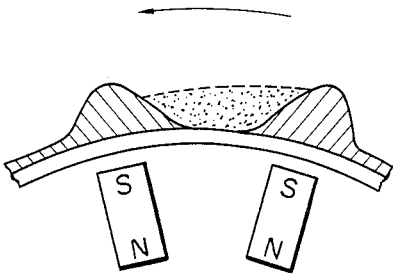
FIG. 2 shows a conditional view illustrating homopolar magnets are adjacently arranged to each other.

The present invention is so devised as to have a magnetic flux distribution of which the peaks are of the homopolar, by arranging such homopolar magnets inside but adjacent to nonmagnetic developing sleeve 1 as shown in FIG. 2.

Figure 3:
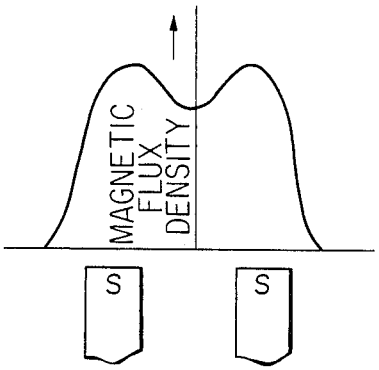
FIG. 3 shows a graph exhibiting the magnetic flux density standing as in the state shown in FIG. 2.

When the homopolar magnets are arranged adjacent to the developing sleeve 1 as shown in FIG. 2, the magnetic force distribution thereof makes such a curve as shown in FIG. 3. When the developing sleeve 1 stands still, developers form two peaks because of the force corresponding to the gradient of the magnetic field and forms a portion where no developer exists, between the peaks. While the developing sleeve 1 is being moved, developers are distributed according to the changes of the magnetic field strength, however, ears of the developer are low in density between the peaks of the magnetic field strength and they will become in a mobile state according to the magnetic field.

In the case that a white streak is caused on the circumferential surface of the developing sleeve 1, the magnetic field around the white streak will have an inclination. When the developer layer on which there caused a white streak of the developer is put in a magnetic field as shown in FIG. 2 and FIG. 3, the developer are mobile according to the inclination of the magnetic field at the place where said developers are liable to be mobile according to the changes of said magnetic field, so that said white streak is buried with developers so as to make the developer layer even. Thus, such a white streak is thereby disappeared after the magnetic field in question passed on. The present invention was so devised as to arrange such a special magnetic field as described above between the doctor blade 2 and the development area and as to make a white streak caused by the doctor blade 2 disappear before it reaches the development area. In the magnetic flux distribution shown in FIG. 3, it is required to set the minimum value to the values of two peaks at a rate between 20% and 95% and in accordance with the experiments the best result was obtained at the rate of the order of 70%.

Figure 4:
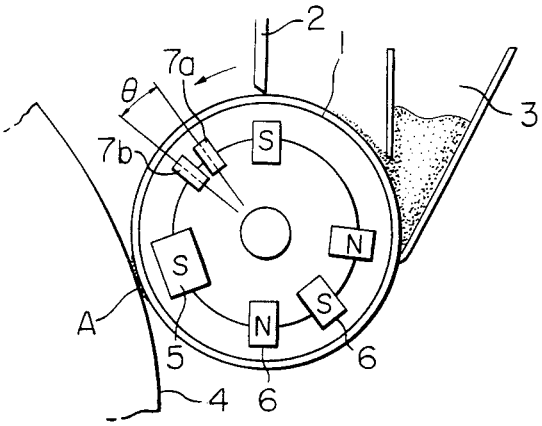
FIG. 4 shows a sectional view of one example of the present invention.

FIG. 4 illustrates an example of the present invention, wherein the numeral 1 is a non-magnetic cylindrical developing sleeve which revolves in the direction of an arrow. The diameter thereof was 30 mmϕ and the rate of revolutions was at 300 r.p.m.

Numeral 2 is a doctor blade for regulating a thickness of the developer layer and the space between the circumferential surface of said developing sleeve 1 and said doctor blade 2 was maintained so as to be 0.2 mm. Inside a developer supply hopper 3, there were stored insulated one component magnetic developer which comprises a resin and 50 wt% of a magnetite being dispersed into the resin so as to be supplied to the sleeve.

Numeral 4 is an electrophotosensitive drum vacuum-evaporated a selenium as an image forming member in which the space between said drum and the cylindrical developing sleeve 1 was kept so as to be 0.3 mm to form development area A. Inside said cylindrical developing sleeve 1, there arranged the fixed permanent magnets, and in the development are there arranged main magnet of the S-pole, and further there arranged magnets 6 for developer transport in other positions.

Each of permanent magnets *7a* and *7b* of the N-pole was arranged so that the angle $\theta$ made to the center of the sleeve can be 15° ($\theta=15°$). The magnetic flux density thereof was 600 gauss on the cylindrical developing sleeve 1. The magnetic flux density of these permanent magnets *7a, 7b* are preferable to be 400–1000 gauss respectively, and as long as they are homopolar and within the said range said two pieces of the magnets *7a, 7b* can well stand even if there is any difference of the magnetic force between them. Whenever they have such constitution as mentioned above, the minimum value of the magnetic flux density taken between the two pieces of magnet *7a, 7b* is within the range of 20%–95% on the cylindrical developing sleeve 1.

The insulated one component magnetic developer having come out from toner supply hopper 3 was forming a developer layer on the surface of the cylindrical developing sleeve 1 and said developer layer was transported on said sleeve 1. The thickness of the developer layer was regulated by the doctor blade 2 to be transported to development area A passing on magnet series 7 in the state adhered over to the cylindrical developing sleeve 1, and the ears of the developer developed a latent image on the electrophotosensitive drum 4.

In the case that coagulated developer was produced in the portion of doctor blade 2 on the cylindrical developing sleeve 1, a white streak was also buried with developer while said streaked portion passed on magnet series 7 by the abovementioned effect to disappear before it reached development area A, and thus the density unevenness was eliminated on the image.

As described of the example above, whenever the present invention is applied, it is possible to eliminate any unevenness of a developer layer such as a white streak caused on a cylindrical developing sleeve to obtain an excellent image without any density unevenness, so that the maintenance cycles can be prolonged. By the way, the present invention is not to destroy or to remove such a coagulated developer causing a white streak, and accordingly it is of course effective to provide a member for cleaning a doctor blade or to provide a member for destroying such coagulated developer, jointly with the use of the means of the present invention.

Every developer to be used in the invention contains preferable not less than 10 wt% of magnetite and 50–60 wt% thereof were the most effective to use. And, as for a developer transport member of the present invention besides a cylindrical developing sleeve, a belt and the like can also be used for, and as for a member for regulating the thickness of developer layer besides a doctor blade, a member for regulating the thickness by means of a roller or the like is of course included therein.

What is claimed is:

1. A developing means for developing an electrostatic latent image on a developing area of an image forming member comprising a non-magnetic developer transport member, a series of magnets arranged inside said non-magnetic transport member, and a developer layer thickness regulating member for regulating a developer layer on the non-magnetic developer transport member, wherein a plurality of said magnets is arranged in series in a defined area between the developer layer thickness regulating member and said developing area opposite said image forming member so as to generate a magnetic flux distribution having a pair of homopolar peaks for eliminating a density unevenness of the developer layer on said transport member.

2. A developing means according to claim 1, further comprising means for supplying a one-component magnetic developer to form said developer layer.

3. A developing means according to claim 1, further comprising means for supplying a one-component magnetic developer comprising a magnetite and a resin to said developer layer.

4. A developing means according to claim 1, wherein a rate of the minimum value taken between two homopolar peaks to the values of said two homopolar peaks in the magnetic flux distribution of the normal line produced on the non-magnetic developer transport member is within the range between not less than 20% and not more than 95%.

5. A developing means according to claim 1, wherein said non-magnetic developer transport member is a cylindrical developing sleeve.

6. A developing means according to claim 1, wherein said developer layer thickness regulating member is a doctor blade.

7. A developing means according to claim 1, wherein said magnetic flux density of magnets arranged in series adjacent are 400–1000 gauss respectively.

* * * * *